US007523511B2

(12) United States Patent
Marr et al.

(10) Patent No.: US 7,523,511 B2
(45) Date of Patent: Apr. 28, 2009

(54) KITCHEN MOUNTING PART

(75) Inventors: Duncan B. Marr, Cheshire (GB); Christian Bomatter, Melisey (FR); Wolfgang Gross, Mohlin (CH); Uli Jost, Riniken (CH)

(73) Assignee: Niro-Plan AG, Aarburg (CH)

( * ) Notice: Subject to any disclaimer, the term of this patent is extended or adjusted under 35 U.S.C. 154(b) by 0 days.

(21) Appl. No.: 11/537,016

(22) Filed: Sep. 29, 2006

(65) Prior Publication Data

US 2007/0151019 A1 Jul. 5, 2007

(30) Foreign Application Priority Data

Oct. 5, 2005 (DE) ..... 10 2005 047 841

(51) Int. Cl.
*E03C 1/33* (2006.01)

(52) U.S. Cl. ..... 4/633

(58) Field of Classification Search ..... 4/631–634, 4/649

See application file for complete search history.

(56) References Cited

U.S. PATENT DOCUMENTS 3,071,780 A * 1/1963 Lyon Jr. ..... 4/633
3,126,552 A * 3/1964 Scharmer ..... 4/633
3,585,657 A * 6/1971 Jensen et al. ..... 4/633
3,680,152 A 8/1972 Farrell

FOREIGN PATENT DOCUMENTS

| | | |
|---|---|---|
| DE | 2 064 248 | 4/1972 |
| DE | 7 414 290 | 8/1974 |
| DE | 40 34 926 | 5/1991 |
| DE | 94 16 466 | 1/1995 |
| DE | 44 39 906 | 11/1995 |
| DE | 44 37 630 | 1/1996 |
| DE | 195 30 365 | 10/1996 |
| DE | 100 07 550 | 9/2000 |
| DE | 102 13 784 | 9/2003 |
| DE | 103 55 032 | 6/2005 |
| FR | 2 729 169 | 7/1996 |

* cited by examiner

*Primary Examiner*—Huyen Le
(74) *Attorney, Agent, or Firm*—Volpe and Koenig, P.C.

(57) ABSTRACT

A kitchen mounting-part (3) is provided which is to be mounted in a cut-out (1*a*) of a countertop, with the mounting-part extending with its edge region (31) beyond the cut-out in the countertop and having numerous mounting elements (8) below the edge region, which can be made to engage the countertop (1). The above-mentioned edge region (31) merges into a sloped splash wall (32). Here, it is essential that the mounting elements (8) are arranged on said splash wall (32), and the edge region (31) is formed from a single layer and extends out above the countertop (1).

16 Claims, 5 Drawing Sheets

KITCHEN MOUNTING PART

BACKGROUND

The invention relates to a mounting-part, such as a kitchen sink, stove top, or the like, which is to be mounted in a cut-out in a countertop, with the mounting-part being bent from sheet metal, in particularly stainless steel sheet, and resting with its edge regions, which extend beyond the cut-out, on the countertop and being provided with numerous mounting elements below the edge region, which elements can engage the countertop and with the above-mentioned edge region merging into a sloped splash wall towards the interior of the mounting-part. At the lower end of said splash wall the other common function areas of the mounting-part follow, such as a sink basin, drainer, cook top, or the like.

In the following the invention is described using the example of an integrated kitchen sink, because this is the primary application for the invention. However, it is also suitable for individual basins and other components to be built in.

A general problem for integrating such kitchen sinks and the like lies in fact that the mounting elements that engage the countertop are accessible from the bottom only. The assembly is therefore awkward and must occur in a tight space. Additionally, a considerable expense in production technology is necessary in order to integrate the mounting elements at the edge of the sink.

Generally the sink is provided with mounting bars near its exterior sides extending downward, which extend into the cut-out of the countertop and at which numerous mounting elements are arranged distributed over the circumference of the sink. The mounting bars are either separate parts welded to the bottom of the sink or they are directly formed by several folds of the rim of the sink, thus the sink is provided with a crimped rim, which first extends inwardly towards the cut-out of the countertop and then extends downwardly inside the cut-out of the countertop. Both measures lead to an increased production expense of the sink. Additionally, they require a relatively wide overhang of the edge region of the sink so that between sink basin and the cut-out of the countertop sufficient space remains for the mounting bars and in particular for the fastening elements. This applies regardless if the mounting elements are embodied as clamping screws, as known from DE 103 55 032, or as autonomously acting bracing springs, as known from DE 20 64 248, for example.

However, the problem described could be avoided by mounting the sink to the countertop using an adhesive, for example according to DE 102 13 784. In practical use such adhesive connections have not proven reliable in the long run.

SUMMARY

The present invention is therefore based on the object to improve the kitchen mounting-parts described at the outset such that they can be produced in a more cost effective manner than previously in spite of a mechanical mounting in the cut-out of the countertop. Additionally, the invention allows better design capabilities for the integrated mounting-part, in particular for its edge design.

This objective is attained according to the invention in that the mounting elements for fastening the mounting-part are arranged at the above-mentioned splash wall of the mounting-part and that the edge region extending beyond the cut-out of the countertop is embodied in a single layer and extends out above the countertop.

This results in the advantage that the previously required mounting bars for accepting the mounting elements can be omitted. Simultaneously the above-mentioned splash wall can be placed farther outward in reference to the cut-out of the countertop; thus, less space is lost for the edge region of the sink, and the basin and drainer can be sized larger for the same size of cut-out of the countertop. The production of the sink is therefore more cost effective and its functionality is improved.

The above-mentioned splash wall can extend immediately adjacent to the cut-out of the countertop such that the horizontal edge region no longer extends approximately 20 mm towards the outside, as previously, but according to the invention less than 15 mm, preferably even less than approximately 12 mm.

In order for the splash wall to be provided with a sufficiently large connection surface for the mounting elements it is recommended that, starting at the protruding wall region, it extends at least approximately 1 cm, preferably approximately 2 cm downwards, before it merges at the bottom into an approximately horizontal wall section. This horizontal wall section is beneficially embossed directly and may immediately merge into a drainer or a basin of the sink. Alternatively, the horizontal wall section may also serve as a frame for a basin, separately welded thereto, or for other functional parts, for example a cook top.

The connection of mounting elements to the splash wall occurs beneficially by soldering, welding, or by adhesion. One skilled in the art would recognize numerous possibilities available for the constructive embodiment of the mounting elements. It is particularly beneficial for the mounting elements to be embodied as U-shaped spring claws, which automatically hook into the cut-out of the countertop with their free legs protruding outward and upward, when the sink is inserted from the top into the cut-out of the countertop.

In order to facilitate this engagement the claw-shaped ends are each provided with an upper edge extending approximately horizontally, which is slightly twisted such that it does not extend parallel but slightly diagonal in reference to the cut-out of the countertop.

Here, it is particularly beneficial for the mounting elements to be combined at least partially from several U-shaped spring claws, arranged side-by-side, and the legs of the spring claws extending outward end in different heights. Using these staggered heights of the spring claws it is ensured that at least some spring claws contact relatively soft areas of the countertop formed of a particle board and can dig in there.

Another beneficial embodiment of the mounting elements is characterized in that, in addition to the above-mentioned spring claws, it is provided with an approximately vertical threaded bore for a clamping element to be screwed in from the bottom, which can be made to contact the countertop. This way an additional mounting possibility is provided in the event that these spring claws alone cannot sufficiently ensure fastening.

The clamping element mentioned can have different shapes. It is very beneficial if it is provided with two angled legs, with one leg corresponding to the bottom of the countertop, while the other leg being in an effective connection to the mounting-part such that it can be pulled downward against the countertop when clamped.

Additional features and advantages of the invention are discernible from the following description of exemplary embodiments and from the drawings, which show:

DETAILED DESCRIPTION OF THE PREFERRED EMBODIMENTS

Figure 1:
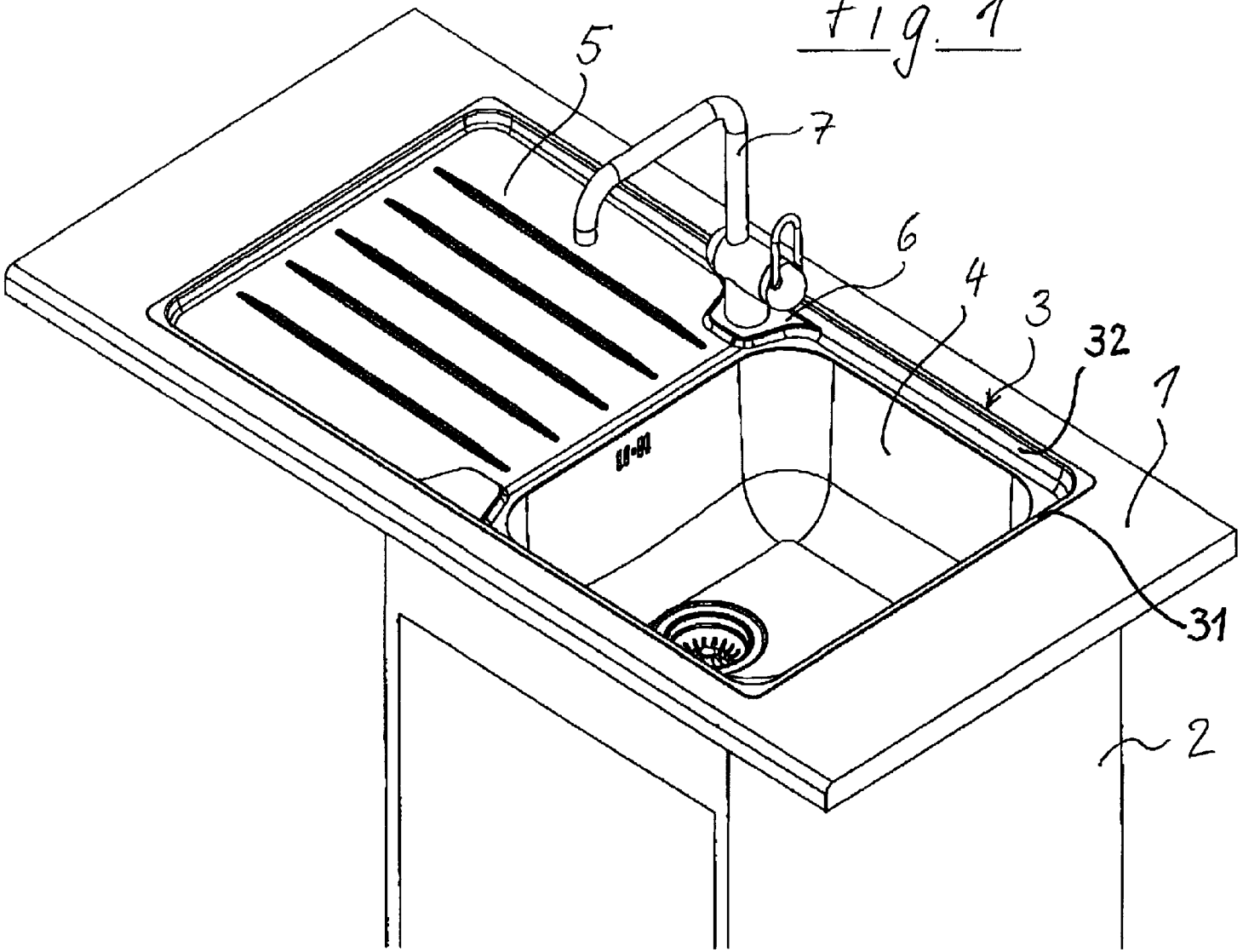
FIG. 1 a perspective view of a sink according to the invention in the installed condition.

In FIG. 1 a conventional countertop 1 is discernible, which rests on a bottom cabinet. In a section 1*a* (see FIG. 2) a sink 3 according to the invention, formed from a single-layer of sheet metal, is installed in the countertop 1. It comprises a basin 4 and a drainer 5 as well as two reverse raised faucet panels 6, one of which carries the faucet 7. Of course, the sink may also include other functional sections, for example a residue basin with a sieve insert or a recessed drainer with a separate drain.

Figure 2:
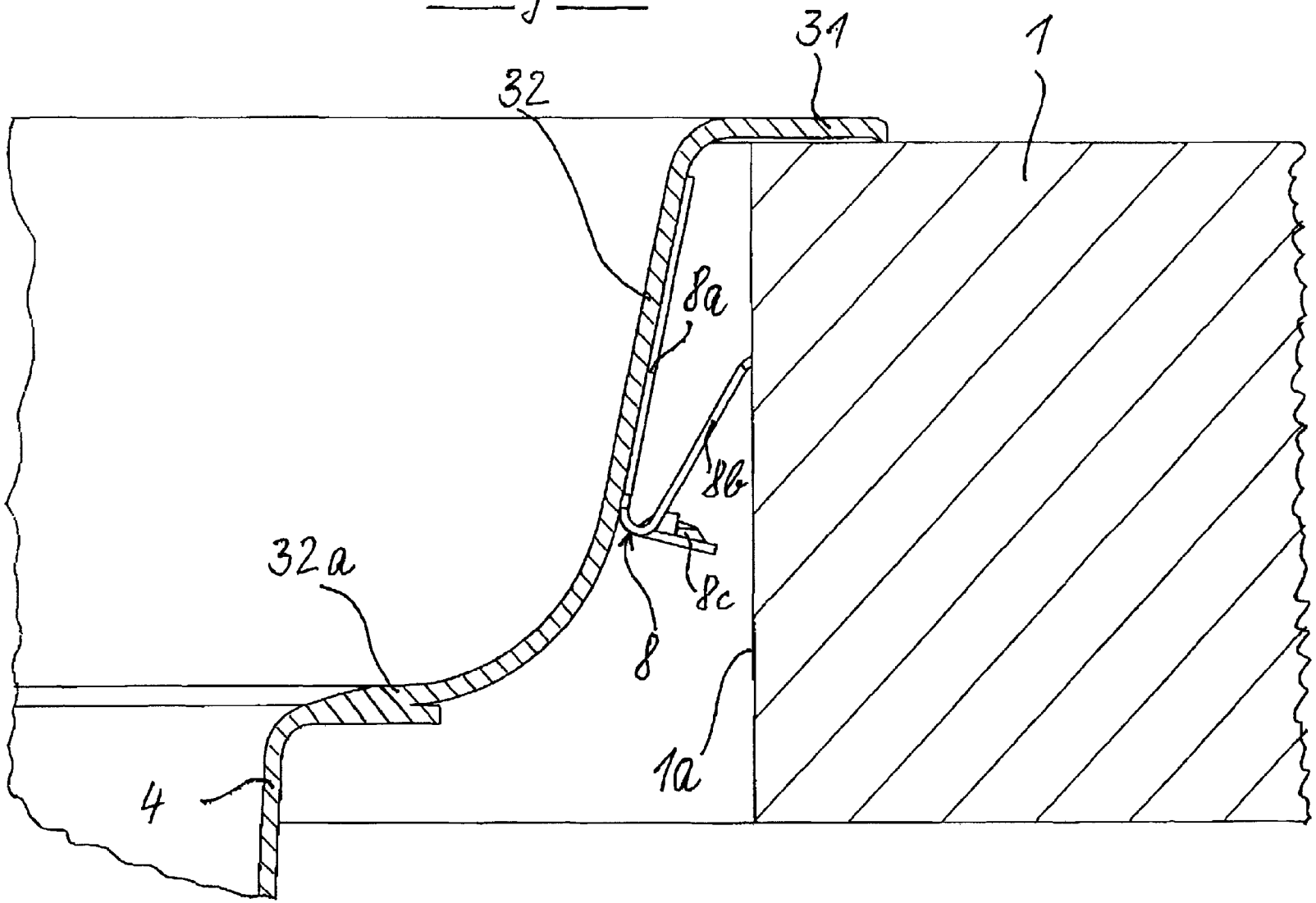
FIG. 2 an enlarged vertical cross-sectional view at the transition from the sink to the countertop.

As discernible primarily from FIG. 2, the sink 3 according to the invention has a horizontal, single-layered edge region 31, extending beyond the cut-out 1*a* of the countertop, which is unusually narrow, in the exemplary embodiment only approximately 10 mm, before it merges inwardly into a steeply sloped splash wall 32. The edge region 31 and the splash wall 32 have the same constant thickness as the other areas of the sink. The splash wall 32 also extends, with its horizontal edge region 31, in the circumferential direction around the entire sink 3. Here, it has a larger vertical step around the basin 4 than the end of the drainer 5, positioned on the left in FIG. 1, because this drainer has a slight slope towards the basin 4. The lower end 32*a* of the splash wall 32 is bent horizontally inwardly and in the position of the cross-section according to FIG. 2, it acts as a frame for the basin 4 welded thereto from below.

However, the scope of the invention also includes for the basin 4 to be formed immediately into the sink by way of deep-drawing such that the lower end 32*a* of the splash wall 32 converts into the basin 4 in a single piece. Such a direct forming by deep-drawing is primarily common if the basin is not very deep or if the splash wall 32 merges into the drainer 5.

The edge region 31 is slightly bent downward at its exterior edge. This results here in a tight pressure against the countertop 1 and allows the gap developing behind the fold between the edge region 31 and the countertop 1 to be filled with silicone.

Additionally, it is essential that the splash wall 32 is sized such that it can immediately accept mounting elements 8 on its exterior side, i.e. omitting any thickening or a fastening bar or an extension of the edge region 31 crimped inwardly, by which the sink is held in the countertop 1, in particular, fixed against being pulled out upwardly.

In the exemplary embodiment, the mounting elements 8 comprise U-shaped spring claws, which are mounted on the splash wall 32 with one of their legs 8*a*, while the other leg 8*b* extends diagonally upward and outward and contacts under stress the vertical cut-out 1*a* of the countertop with its slightly twisted upper edge 8*f* and claws into it.

Figure 3:
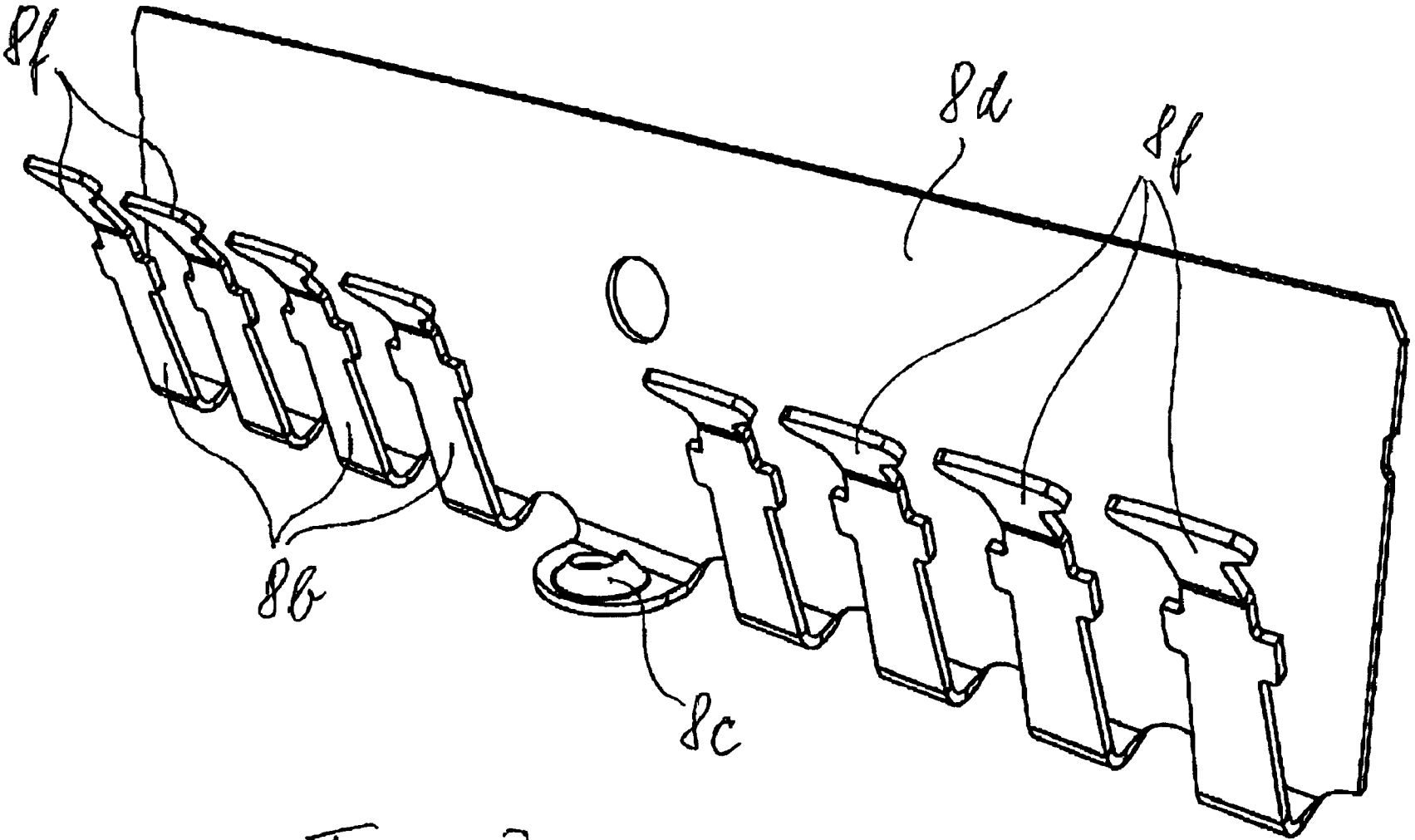
FIG. 3 an enlarged diagonal view of a mounting element having several spring claws.

FIG. 3 illustrates the structure of the U-shaped spring claws. Here it is discernible that numerous spring claws, arranged side-by-side, are combined with one another such that a multitude of spring legs 8*b* extend from a joint base plate 8*d*; and the base plate 8*d* is connected to the exterior of the splash wall 32.

In the event the spring claws alone cannot ensure a tight fastening at all places of the circumference of the sink, the spring claws are also provided with a threaded bore 8c. Using this threaded bore, as shown in FIG. 4, an additional clamping element 9 can be mounted, which engages the bottom of the countertop 1 and allows a form-fitting clamping of the sink downwards.

Figure 5:
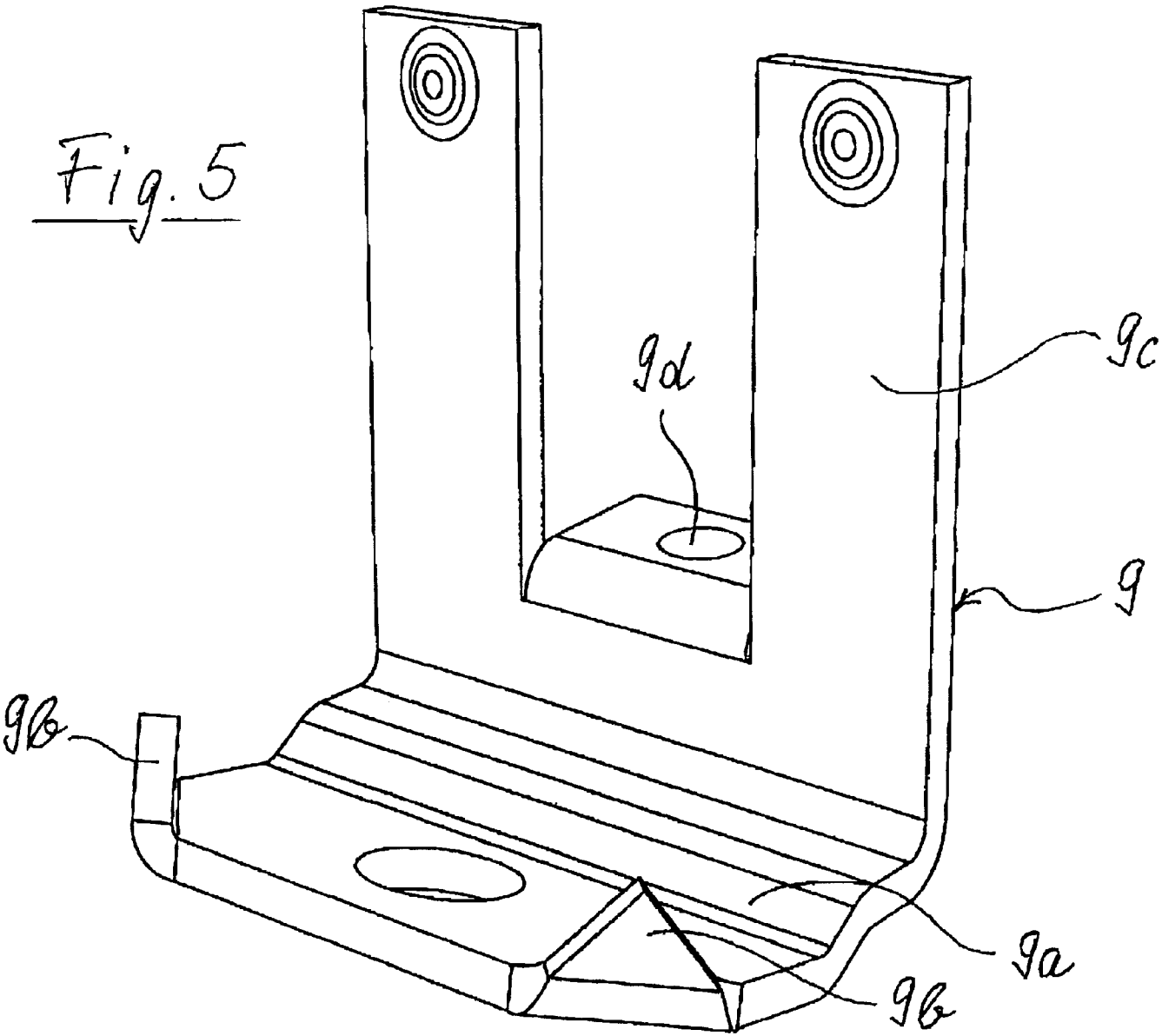
FIG. 5 an enlarged perspective view of a clamping element.

FIG. 5 illustrates the structure of the clamping element 9. It has an approximately L-shaped form and engages the bottom of the countertop 1 with its approximately horizontal lower leg 9*a*, in particularly with the claws 9*b* arranged there and extending upwardly. Its other leg 9*c*, comprising two parts arranged side-by-side, extends upwards along the cut-out 1*a* of the countertop and has a through bore 9*d*, which is approximately aligned to the threaded bore arranged thereabove.

Figure 4:
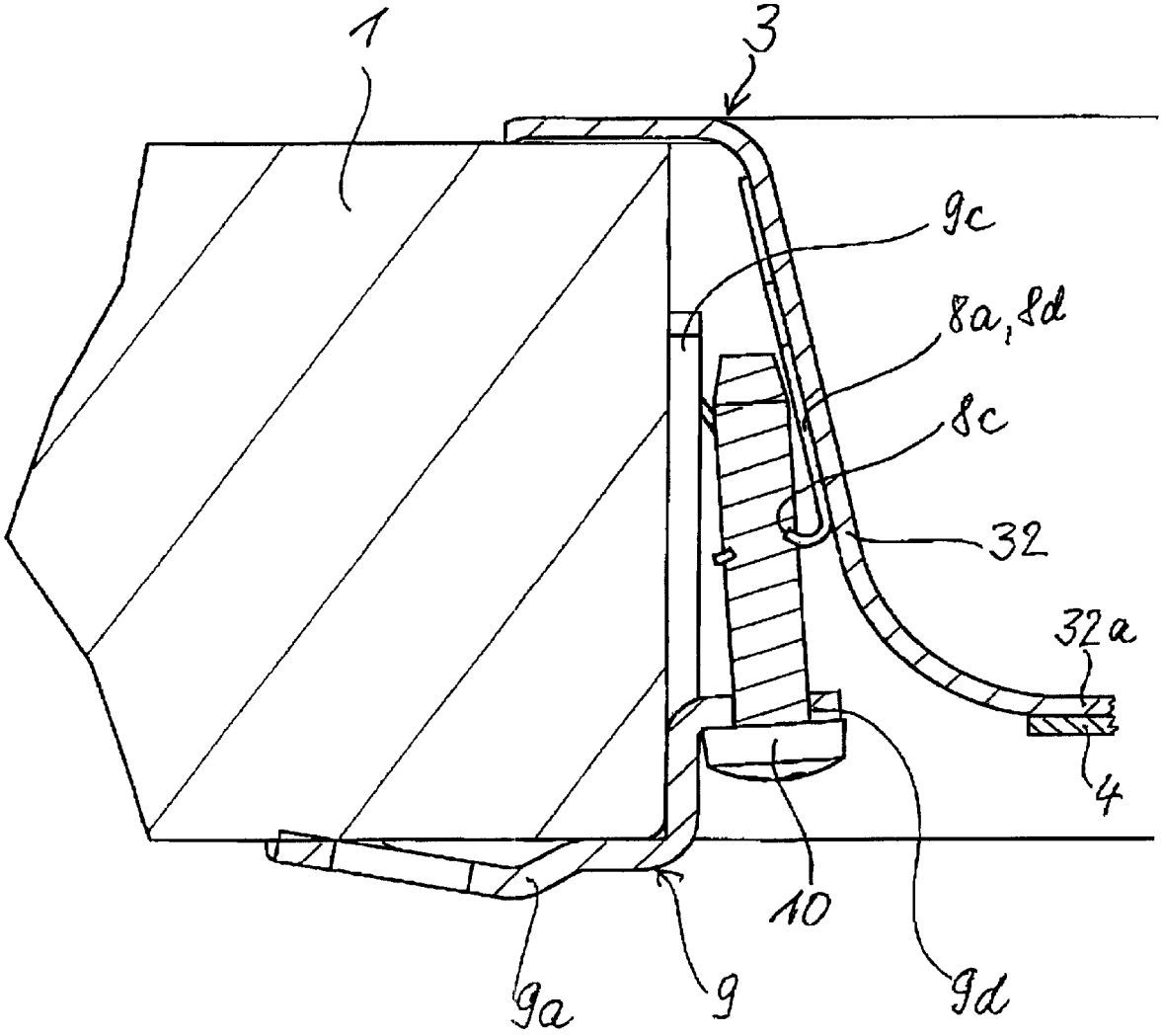
FIG. 4 a vertical cross-sectional view similar to FIG. 2, but ever having an additional clamping element.

As discernible in FIG. 4, a screw 10 can be put through the bore 9*c* from the bottom, which then engages the threaded bore 8*c* with its thread. With an increased torque of the screw 10 the screw head finally contacts the bottom of the clamping element 9 and pulls the threaded bore 8*c* and thus the splash wall of the sink downwards. This form-fitting clamping of the sink is particularly useful when the countertop 1 is made from granite or a similar material into which the upper ends 8*f* of the spring claws 8 cannot dig-in.

Summarizing, the invention is characterized in that the mounting elements for the sink are no longer arranged at a crimped edge or a separate mounting bar but immediately at an approximately vertical splash wall, which is adjacent to the protruding edge of the sink and forms the transition to the basin, the drainer, or other functional surfaces and that by omitting the crimped edge and/or mounting bars the sink can be produced more cost effectively and with considerably narrower edge regions than previously possible. Additionally, by its flat, level edge the sink according to the invention is well suited for a flush installation into a countertop.

The invention claimed is:

1. A mounting-part, which is to be mounted in the cut-out (1*a*) of a countertop (1), with the mounting-part resting with its edge region (31) thereof, extending beyond the cut-out (1*a*) of the countertop and onto the countertop (1) and being provided with a plurality of mounting elements (8) below the edge region, wherein the mounting elements are at least partially combined from several U-shaped spring claws arranged side by side with free ends of the spring claws extending outwardly at different heights so that the spring claws have staggered heights, which elements can engage the countertop (1) and the edge region (31) extends toward the interior of the mounting-part into a sloped splash wall (32), the mounting elements (8) for fastening the mounting-part in the countertop (1) are arranged on the splash wall (32) and the edge region (31) extending beyond the cut-out (1*a*) of the countertop is formed in a single layer and extends out above the countertop (1).

2. A mounting-part according to claim 1, wherein the splash wall (32) extends immediately adjacent to the cut-out (1*a*) of the countertop.

3. A mounting-part according to claim 1, wherein in reference to an upper end of the splash wall (32), the edge region (31) extends outwardly less than 15 mm.

4. A mounting-part according to claim 1, wherein the splash wall (32) beginning from the edge region (31) extends downwardly at least 1 cm.

5. A mounting-part according to claim 1, wherein the splash wall (32) merges downwardly into an approximately horizontal wall section (32*a*).

6. A mounting-part according to claim 5, wherein the approximately horizontal wall section (32*a*) comprises a drainer (5) of a sink (3).

7. A mounting-part according to claim 5, wherein the approximately horizontal wall section (32*a*) comprises a frame for operational parts.

8. A mounting-part according to claim 5, wherein the approximately horizontal wall section (32*a*) comprises a frame for supporting a cook top.

9. A mounting-part according to claim 1, wherein the mounting elements (8) are adhered or welded to the splash wall (32).

10. A mounting-part according to claim 1, wherein the claw-shaped ends each have an approximately horizontally extending upper edge (8*f*).

11. A mounting-part according to claim 10, wherein the upper edge (8*f*) is slightly bent.

12. A mounting-part according to claim 1, wherein the mounting-part is formed from stainless steel sheet metal.

13. A mounting-part according to claim 1, wherein the splash wall (32) and the edge region (31) are provided with the same wall thickness.

14. A mounting-part according to claim 1, wherein the mounting-part comprises a kitchen sink or a cook top.

15. A mounting-part, which is to be mounted in a cut-out (1*a*) of a countertop (1), with the mounting-part resting with an edge region (31) thereof, extending beyond the cut-out (1*a*) of the countertop and onto the countertop (1) and being provided with a plurality of mounting elements (8) below the edge region, which elements can engage the countertop (1) and the edge region (31) extends toward an interior of the mounting-part into a sloped splash wall (32), the mounting elements (8) for fastening the mounting-part in the countertop (1) are arranged on the splash wall (32) and the edge region (31) extending beyond the cut-out (1*a*) of the countertop is formed as a single layer and extends out above the countertop (1), and the mounting elements, in addition to the spring claws (8), are provided with an approximately vertical threaded bore (8*c*) for connection with a clamping element (9) which is fastenable from a bottom thereof by screws, and which can be made to contact the countertop (1).

16. A mounting-part according to claim 15, wherein the clamping element (9) has two legs (9*a*, 9*c*), with one leg (9*a*) corresponding to the bottom of the countertop (1), while the other leg (9*c*) supports the mounting-part.

* * * * *